US011732585B2

(12) United States Patent
Hagan et al.

(10) Patent No.: US 11,732,585 B2
(45) Date of Patent: Aug. 22, 2023

(54) TRAPPED ROTATABLE WEIGHTS TO IMPROVE ROTOR BALANCE

(71) Applicant: General Electric Company, Schenectady, NY (US)

(72) Inventors: Robert Allen Hagan, Reading, MA (US); Jason Francis Pepi, Augusta, ME (US); Kevin Robert Shannon, Boston, MA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/161,490

(22) Filed: Jan. 28, 2021

(65) Prior Publication Data

US 2022/0235662 A1 Jul. 28, 2022

(51) Int. Cl.
*F01D 5/02* (2006.01)

(52) U.S. Cl.
CPC ..... *F01D 5/027* (2013.01); *F05D 2220/32* (2013.01); *F05D 2240/24* (2013.01); *F05D 2240/30* (2013.01); *F05D 2260/15* (2013.01); *F05D 2260/34* (2013.01)

(58) Field of Classification Search
CPC ..... F01D 5/027; F01D 5/066; F01D 25/04; F01D 25/06; G01M 1/32
See application file for complete search history.

(56) References Cited

U.S. PATENT DOCUMENTS 3,736,811 A * 6/1973 Neary ..... F01D 5/027 464/180
3,916,495 A * 11/1975 Klassen ..... F01D 5/066 29/888.011
4,117,742 A 10/1978 Stein
4,842,485 A * 6/1989 Barber ..... F16F 15/322 411/84
5,205,189 A 4/1993 Westing et al.
6,279,420 B1 * 8/2001 Knorowski ..... F16F 15/322 409/234
6,481,969 B2 * 11/2002 Berry ..... F01D 5/027 416/500
7,377,749 B2 5/2008 Charrier et al.
7,470,115 B2 * 12/2008 Meacham ..... F01D 5/025 416/244 R
7,685,876 B2 3/2010 Mollmann et al.
8,051,709 B2 11/2011 Allen et al.
8,051,710 B2 11/2011 Van Dam et al.
(Continued)

OTHER PUBLICATIONS

Bill Hillman, Ludeca, Inc., "Balancing Rigid Rotors in the Field," Machinery Lubrication, Reliable Plant Conference Noria, [Retrieved from the Internet on Jul. 1, 2020]. Retrieved from the Internet: https://www.reliableplant.com/Read/29478/field-balancing-rotors#t:~text=Balanced (13 pages).

*Primary Examiner* — J. Todd Newton
*Assistant Examiner* — Behnoush Haghighian
(74) *Attorney, Agent, or Firm* — Dinsmore & Shohl LLP

(57) ABSTRACT

Methods, apparatus, and systems for trapped rotatable weights to improve rotor balance are disclosed. An example apparatus includes a lock nut; a rotor assembly; a channel defined by the lock nut and the rotor assembly, the channel wrapped circumferentially around a geometric center of the rotor assembly; and a weight trapped within the channel.

14 Claims, 3 Drawing Sheets

(56) References Cited

U.S. PATENT DOCUMENTS 8,186,954 B2 5/2012 Lee et al.
8,313,279 B2 11/2012 Mollmann
8,342,804 B2 * 1/2013 Pronovost ..... F01D 5/02 416/182
8,348,616 B2 * 1/2013 Williams ..... F01D 5/027 416/119
8,506,253 B2 * 8/2013 Lecuyer ..... F01D 5/10 416/145
8,784,062 B2 * 7/2014 Suciu ..... F01D 5/02 416/198 A
9,017,029 B2 * 4/2015 Pichel ..... F01D 5/027 416/144
9,127,556 B2 * 9/2015 Pronovost ..... F01D 5/027
9,260,977 B2 * 2/2016 Milner ..... F01D 1/24
9,297,258 B2 * 3/2016 Woods ..... F01D 5/027
9,511,457 B2 * 12/2016 Stone ..... B23P 15/02
9,588,007 B2 3/2017 Thompson et al.
9,638,037 B2 * 5/2017 Stone ..... G01M 1/34
9,790,792 B2 * 10/2017 Suciu ..... F01D 5/02
10,570,741 B2 * 2/2020 Stone ..... G01M 1/34
10,598,018 B2 * 3/2020 Stone ..... F16F 15/32
10,697,300 B2 * 6/2020 Rosborough ..... H02K 15/165
10,954,793 B2 * 3/2021 Korn ..... F04D 29/662
2005/0265846 A1 * 12/2005 Przytulski ..... F01D 5/027 416/144
2006/0013693 A1 * 1/2006 Meacham ..... F01D 5/066 416/244 R
2010/0080705 A1 * 4/2010 Pronovost ..... F01D 5/02 29/889
2010/0316496 A1 * 12/2010 Williams ..... F01D 5/027 416/144
2011/0044816 A1 * 2/2011 Lecuyer ..... F01D 5/027 29/889.21
2012/0207603 A1 * 8/2012 Woods ..... F01D 5/027 416/145
2012/0282082 A1 * 11/2012 Pichel ..... F01D 5/027 415/119
2013/0017092 A1 * 1/2013 Miller ..... F01D 5/066 416/196 R
2013/0086805 A1 * 4/2013 Pronovost ..... F01D 5/02 29/889.23
2013/0108466 A1 * 5/2013 Suciu ..... F01D 5/02 29/889
2013/0209260 A1 * 8/2013 Stone ..... B23P 15/02 29/889.7
2014/0294589 A1 * 10/2014 Suciu ..... F01D 5/02 416/204 R
2016/0290156 A1 10/2016 Le Strat et al.
2016/0333695 A1 11/2016 Gerez et al.
2017/0074104 A1 * 3/2017 Stone ..... F16F 15/32
2017/0284419 A1 10/2017 Bishop et al.
2018/0354630 A1 12/2018 Nakhjavani
2019/0186266 A1 * 6/2019 Rosborough ..... G01M 1/32
2020/0200013 A1 * 6/2020 Stone ..... F01D 5/027
2021/0003012 A1 * 1/2021 Rosborough ..... G01M 1/32
2021/0156757 A1 * 5/2021 Meng ..... G01M 1/22
2021/0246799 A1 * 8/2021 Hiwatashi ..... F01D 5/027

* cited by examiner

TRAPPED ROTATABLE WEIGHTS TO IMPROVE ROTOR BALANCE

FEDERALLY SPONSORED RESEARCH

This invention was made with Government support under W58RGZ-16-C-0047 awarded by the U.S. Army. The Government has certain rights in this invention.

FIELD OF THE DISCLOSURE

This disclosure relates generally to rotors and, more particularly, to trapped rotatable weights to improve rotor balance.

BACKGROUND

In recent years, turbine engines have been increasingly utilized in a variety of applications and fields. Turbine engines are intricate machines with extensive availability, reliability, and serviceability requirements. Turbine engines include rotors with fan blades. The rotor and fan blades rotate at high speed and subsequently compress the air flow. The high-pressure compressor then feeds the pressurized air flow to a combustion chamber to generate a high-temperature, high-pressure gas stream. One characteristic of a rotor is balance. The balance of the rotor corresponds to the location of the center of mass of the rotor with respect to the geometric center of the rotor. The closer the center of mass is to the geometric center, the more balanced the rotor is. During implementation, balanced rotors have less vibration than unbalanced rotors, thereby leading to less probability of damage or error, larger lifespan, etc.

BRIEF SUMMARY

Methods, apparatus, systems, and articles of manufacture corresponding to trapped rotatable weights to improve rotor balance are disclosed.

Certain examples provide an example apparatus comprising a lock nut, a rotor assembly, a channel defined by the lock nut and the rotor assembly, the channel wrapped circumferentially around a geometric center of the rotor assembly, and a weight trapped within the channel.

Certain examples provide an example turbine engine comprising a shaft and a rotor coupled to the shaft, the rotor including a section defining a channel around a geometric center of the rotor, the channel including a weight trapped within the channel and movable within the channel.

Figure 1:
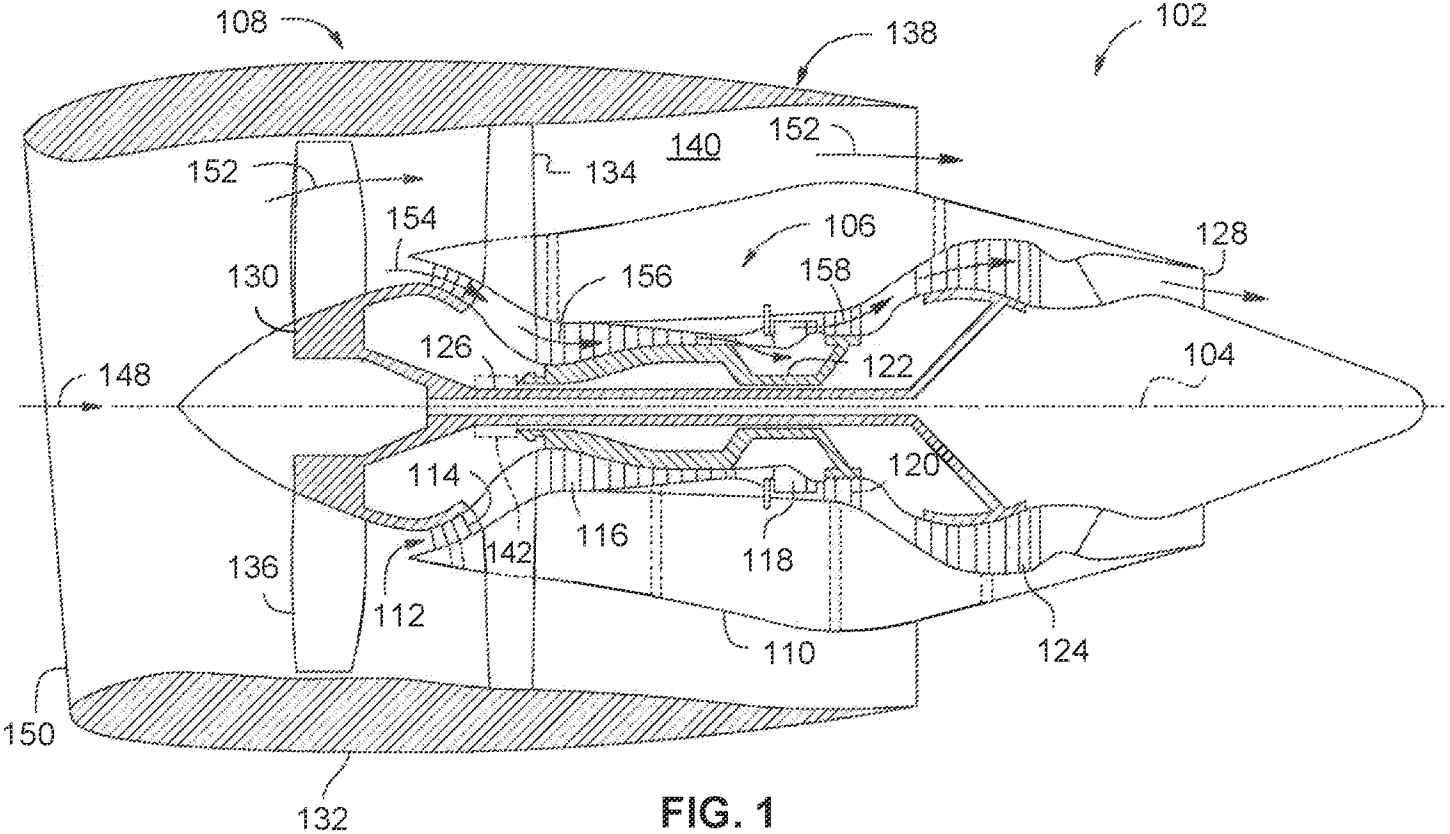
FIG. 1 illustrates an example gas turbine engine that can be utilized within an aircraft in which the examples disclosed herein can be implemented.

The figures are not to scale. Instead, the thickness of the layers or regions may be enlarged in the drawings. In general, the same reference numbers will be used throughout the drawing(s) and accompanying written description to refer to the same or like parts. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Stating that any part is in "contact" with another part means that there is no intermediate part between the two parts. Although the figures show layers and regions with clean lines and boundaries, some or all of these lines and/or boundaries may be idealized. In reality, the boundaries and/or lines may be unobservable, blended, and/or irregular.

Descriptors "first," "second," "third," etc. are used herein when identifying multiple elements or components which may be referred to separately. Unless otherwise specified or understood based on their context of use, such descriptors are not intended to impute any meaning of priority, physical order or arrangement in a list, or ordering in time but are merely used as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

DETAILED DESCRIPTION

In the following detailed description, reference is made to the accompanying drawings that form a part hereof, and in which is shown by way of illustration specific examples that may be practiced. These examples are described in sufficient detail to enable one skilled in the art to practice the subject matter, and it is to be understood that other examples may be utilized. The following detailed description is therefore, provided to describe an exemplary implementation and not to be taken limiting on the scope of the subject matter described in this disclosure. Certain features from different aspects of the following description may be combined to form yet new aspects of the subject matter discussed below.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

As used herein, the terms "system," "unit," "module," "engine," "component," etc., may include a hardware and/or software system that operates to perform one or more functions. For example, a module, unit, or system may include a computer processor, controller, and/or other logic-based device that performs operations based on instructions stored on a tangible and non-transitory computer readable storage medium, such as a computer memory. Alternatively, a module, unit, or system may include a hard-wires device that performs operations based on hard-wired logic of the device. Various modules, units, engines, and/or systems shown in the attached figures may represent the hardware that operates based on software or hardwired instructions, the software that directs hardware to perform the operations, or a combination thereof.

A turbine engine, also called a combustion turbine or a gas turbine, is a type of internal combustion engine. Turbine engines are commonly utilized in aircraft and power-generation applications. As used herein, the terms "asset," "aircraft turbine engine," "gas turbine," "land-based turbine engine," and "turbine engine" are used interchangeably. A basic operation of the turbine engine includes an intake of fresh atmospheric air flow through the front of the turbine engine with a rotor that includes fans. In some examples, the air flow travels through an intermediate-pressure compressor or a booster compressor located between the fan and a high-pressure compressor. The booster compressor is used to supercharge or boost the pressure of the air flow prior to the air flow entering the high-pressure compressor. The air flow can then travel through the high-pressure compressor that further pressurizes the air flow. The high-pressure compressor includes a group of blades (e.g., fans) attached to a shaft. The blades spin at high speed and subsequently compress the air flow. The high-pressure compressor then feeds the pressurized air flow to a combustion chamber. In some examples, the high-pressure compressor feeds the pressurized air flow at speeds of hundreds of miles per hour. In some instances, the combustion chamber includes one or more rings of fuel injectors that inject a steady stream of fuel into the combustion chamber, where the fuel mixes with the pressurized air flow.

In the combustion chamber of the turbine engine, the fuel is ignited with an electric spark provided by an igniter, where the fuel, in some examples, burns at temperatures of more than 2000 degrees Fahrenheit. The resulting combustion produces a high-temperature, high-pressure gas stream (e.g., hot combustion gas) that passes through another group of blades called a turbine. In some examples, a turbine includes an intricate array of alternating rotating rotors and stationary airfoil-section rotors. Alternatively, the turbine can be structured with adjacent rotating rotors or stationary airfoil section rotors, or in any combination of alternating or adjacent airfoil-section blades. As the hot combustion gas passes through the turbine, the hot combustion gas expands, causing rotating blades of the rotating rotors to spin. The rotating blades of the rotating rotors serve at least two purposes. A first purpose of the rotating blades is to drive the booster compressor and/or the high-pressure compressor to draw more pressured air into the combustion chamber. For example, the turbine is attached to the same shaft as the high-pressure compressor in a direct-drive configuration, thus, the spinning of the turbine causes the high-pressure compressor to spin. A second purpose of the rotating blades is to spin a generator operatively coupled to the turbine section to produce electricity. For example, the turbine can generate electricity to be used by an aircraft, a power station, etc.

In the example of an aircraft turbine engine, after passing through the turbine, the hot combustion gas exits the aircraft turbine engine through a nozzle at the back of the aircraft turbine engine. As the hot combustion gas exits the nozzle, the aircraft turbine engine and the corresponding aircraft coupled to the aircraft turbine engine are accelerated forward (e.g., thrusted forward). In the example of a land-based turbine engine, after passing through the turbine, the hot combustion gas is dissipated, used to generate steam, etc.

When the geometric center of a rotor and the center of mass of the rotor are not at the same point, the rotor is unbalanced. Unbalanced rotors create higher vibrations than balanced rotors (e.g., the more a rotor is unbalanced, the higher the vibrations that occur during rotation). Higher vibrations are undesirable as they lead to an increased likelihood of damage, increased energy consumption, decrease lifespan, and reduced efficiency. The more balanced a rotor is (e.g., the closer the center of mass is to the geometric center of the rotor), the lower the vibrations that occur while the rotor rotates (e.g., spins). During the manufacturing process, a technician performs a balancing test to identify how balanced the rotor is (e.g., where the center of mass is with respect to the geometric center). If the technician determines that the rotor is unbalanced by more than a threshold amount (e.g., the center of mass is more than a threshold distance away from the geometric center), the technician can add weights to different portions of the rotor, thereby adjusting the center of mass. The technician can then retest the balance of the rotor and add and/or subtract weight from the same or a different portion of the rotor until the balance of the rotor satisfies the balance threshold, thereby increasing the balance of the rotor to an acceptable level. The acceptable level and/or the balance threshold can be based on user, industry, manufacturers, and/or protocol standards.

Traditionally, the balance weights are installed after an initial rotor balance check but before installation of a rotor into the engine assembly. However, after the rotor is initially assembled, the center of mass can be moved during or after subsequent assembly procedures. Additionally, some traditional balance weights require removal of the rotor from the machine that tests the balance of the rotor to adjust, which is a tedious and time-consuming process. Examples disclosed herein provide a structure that facilitates balance weight adjustments after installation without disassembly of the rotor and/or other parts of a turbine engine by removal of the rotor, a locknut, and/or a tie bolt.

Traditional techniques for installing weights that can be adjusted after installation with minimal rotor disassembly include a housing including an open cavity that includes a slot wide enough so that a weight can be placed into the cavity. The slot can be structured so that the weight can only be put into the cavity when the weight is positioned at certain angles. In such traditional techniques, the weight includes a threaded insert through the weight so that a technician can secure the weight to housing with a screw or bolt. However, because the slot is big enough to allow the weight to enter the cavity, the weight can exit the cavity as well (e.g., if the screw or bolt that holds the balance weight in place breaks, fails, or becomes loose). Accordingly, if the screw or bolt fails to hold the weight in place, the weight can be projected out of the rotor and cause damage to the rotor and/or the rest of the turbine engine. Examples disclosed herein achieve rotor balance in a boltless rotor architecture, where a fixed number of weights are trapped (e.g., cannot be removed) in a channel (as referred to as annulus, slot, chamber, groove, cavity, etc.) corresponding to the rotor during installation (e.g., connecting the rotor to other parts via a lock nut and/or tie bolt). The trapped weights can be moved circumferentially within the channel (e.g., around the circumference of the geometric center of the rotor) to adjust the balance of the rotor (e.g., by moving the one or more weights, the center of mass of the rotor is moved). However, once the lock nut is installed, the balance weight cannot be removed from the rotor unless disassembled. Rather, the balance weight can only be rotated around the geometric center of the rotor to adjust the balance of the rotor. In some examples, the part of the rotor into which the weights are fixed in the cavity/channel can include tabs, slots, dimples, etc., to clock and/or lock the balance weight into a preset positions around the circumference of the rotor so that a balance weight can lock into positions corresponding to the tabs, slots, dimples, etc. Examples disclosed herein allow a rotor to be balanced before, during, and/or after installation of a rotor and/or within a balance test machine without disassembly of the rotor by removal of the rotor, a locknut, and/or a tie bolt.

FIG. 1 is a schematic illustration of an example gas turbine engine 102. The example gas turbine engine 102 includes an example core gas turbine engine 106, an example fan section 108, an example outer casing 110, an example annular inlet 112, an example booster compressor 114, an example high-pressure, multi-stage, axial-flow compressor 116, an example combustor 118, a first example turbine 120, a first example drive shaft 122, a second example turbine 124, a second example drive shaft 126, an example exhaust nozzle 128, an example axial-flow fan rotor assembly 130, an example annular fan casing 132, example guide vanes 134, example fan rotor blades 136, an example downstream section 138, an example airflow conduit 140, an example speed reduction device 142, an example inlet 150, and example combustion products 158.

FIG. 1 is a cross-sectional view of the engine 102 that can be utilized within an aircraft in accordance with aspects of the disclosed examples. The gas turbine engine 102 is shown having a longitudinal or axial centerline axis 104 extending throughout the gas turbine engine 102 for reference purposes. As used herein, the terms "axial" and "longitudinal" both refer to a direction parallel to the centerline axis 104, while "radial" refers to a direction perpendicular to the axial direction, and "tangential" or "circumferential" refers to a direction mutually perpendicular to the axial and radial directions. As used herein, the terms "forward" or "front" refer to a location relatively upstream in an air flow passing through or around a component, and the terms "aft" or "rear" refer to a location relatively downstream in an air flow passing through or around a component. The direction of this flow is shown by an arrow 148 in FIG. 1. These directional terms are used merely for convenience in description and do not require a particular orientation of the structures described thereby. The example centerline axis 104 represents the geometric center of rotors (e.g., including the example rotor assembly 130).

The engine 102 of FIG. 1 includes the core gas turbine engine 106 and the fan section 108 positioned upstream thereof. The core gas turbine engine 106 can generally include the substantially tubular outer casing 110 that defines an annular inlet 112. In addition, the outer casing 110 can further enclose and support the booster compressor 114 for increasing the pressure of the air that enters the core gas turbine engine 106 to a first pressure level. The high-pressure, multi-stage, axial-flow compressor 116 can then receive the pressurized air from the booster compressor 114 and further increase the pressure of such air to a second pressure level. Alternatively, the high-pressure, multi-stage compressor 116 can be a high-pressure, multi-stage centrifugal compressor or a high-pressure, multi-stage axial-centrifugal compressor.

In the illustrated example of FIG. 1, the pressurized air exiting the high-pressure compressor 116 can then flow to the combustor 118 within which fuel is injected into the flow of pressurized air, with the resulting mixture being combusted within the combustor 118. The high-energy combustion products are directed from the combustor 118 along the hot gas path of the engine 102 to the first (high-pressure) turbine 120 for driving the high-pressure compressor 116 via the first (high-pressure) drive shaft 122, and then to the second (low-pressure) turbine 124 for driving the booster compressor 114 and fan section 108 via the second (low-pressure) drive shaft 126 that is generally coaxial with first drive shaft 122. After driving each of the turbines 120 and 124, the combustion products can be expelled from the core gas turbine engine 106 via the exhaust nozzle 128 to provide propulsive jet thrust.

In some examples, each of the compressors 114, 116 can include a plurality of compressor stages, with each stage including both an annular array of stationary compressor vanes and an annular array of rotating compressor blades (e.g., rotors that are part of the compressor) positioned immediately upstream of the compressor vanes. Similarly, each of the turbines 120, 124 can include a plurality of turbine stages, each stage including both an annular array of stationary nozzle vanes and an annular array of rotating turbine blades positioned immediately downstream of the nozzle vanes.

Additionally, as shown in FIG. 1, the fan section 108 of the engine 102 can generally include the rotatable, axial-flow fan rotor assembly 130 (e.g., also referred to as rotor) that is configured to be surrounded by the annular fan casing 132. The fan casing 132 can be configured to be supported relative to the core gas turbine engine 106 by the plurality of substantially radially-extending, circumferentially-spaced outlet guide vanes 134. As such, the fan casing 132 can enclose the fan rotor assembly 130 and its corresponding fan rotor blades 136. Moreover, the downstream section 138 of the fan casing 132 can extend over an outer portion of the core gas turbine engine 106 to define the secondary, or by-pass, airflow conduit 140 that provides additional propulsive jet thrust. A detailed example of the fan rotor blades 136 is further described below in conjunction with FIG. 2.

In some examples, the second (low-pressure) drive shaft 126 is directly coupled to the fan rotor assembly 130 to provide a direct-drive configuration. Alternatively, the second drive shaft 126 can be coupled to the fan rotor assembly 130 via the speed reduction device 142 (e.g., a reduction gear or gearbox) to provide an indirect-drive or geared drive configuration. Such a speed reduction device(s) can also be provided between any other suitable shafts and/or spools within the engine 102 as desired or required.

During operation of the engine 102, an initial air flow (indicated by arrow 148) can enter the engine 102 through the associated inlet 150 of the fan casing 132. The air flow 148 then passes through the fan blades 136 and splits into a first compressed air flow (indicated by arrow 152) that moves through conduit 140 and a second compressed air flow (indicated by arrow 154) which enters the booster compressor 114. The pressure of the second compressed air flow 154 is then increased and enters the high-pressure compressor 116 (as indicated by arrow 156). After mixing with fuel and being combusted within the combustor 118, the combustion products 158 exit the combustor 118 and flow through the first turbine 120. Thereafter, the combustion products 158 flow through the second turbine 124 and exit the exhaust nozzle 128 to provide thrust for the engine 102.

Figure 2:
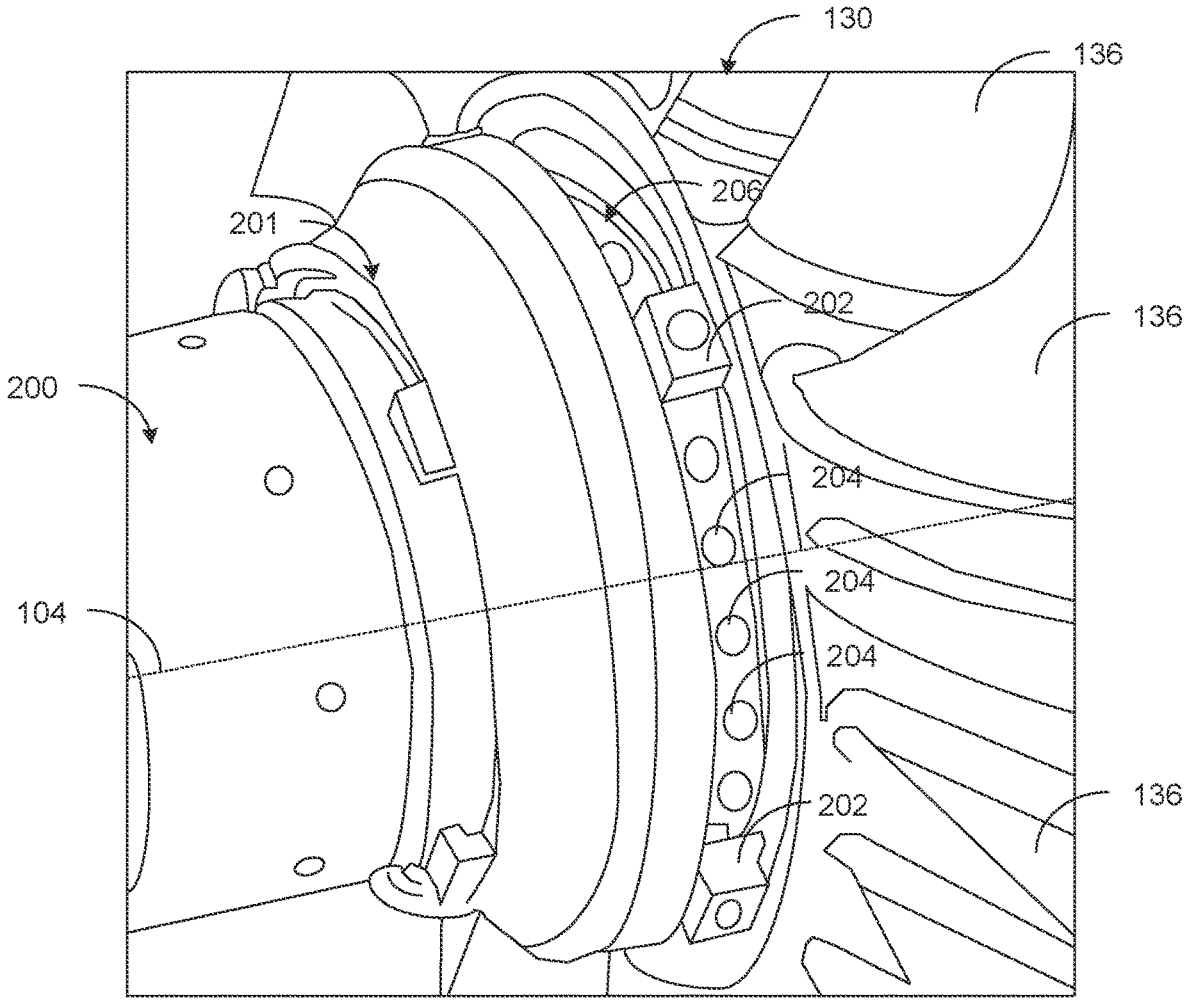
FIG. 2 is an example implementation of the rotor assembly of FIG. 1 including trapped movable balance weights.

FIG. 2 illustrates am implementation of the example rotor assembly 130 coupled to an example shaft 200 (also referred to as drive shaft). In the example of FIG. 2, the rotor assembly 130 includes the fan blades 136, balance weight 202, dimples 204, and a channel 206 (e.g., annulus, slot, chamber, groove, cavity, etc.) arranged based on the structure of the drive shaft 200, the lock nut 201, and/or the rotor assembly 130). Although FIG. 2 illustrates an example implementation including the balance weights 202 in conjunction with the rotor assembly 130 of FIG. 1, the balance weights 202 can be implemented in conjunction with different drive shafts and/or in different rotor types (e.g., the rotational rotors implemented in the compressor(s) 114, 116 and/or any other type of rotational rotor).

The drive shaft 200 of FIG. 2 is coupled to the rotor assembly 130 via a tie-bolt. Since the drive shaft 200 is coupled to the rotor assembly 130 with the tie-bolt, when the drive shaft 200 rotates, the rotor assembly 130 (e.g., including the fan blades 136) also rotates. As described above, rotation of the fan blade 136 can drive the booster compressor and/or the high-pressure compressor to draw more pressured air into the combustion chamber and/or rotation of the fan blades 136 can spin a generator operatively coupled to the turbine section to produce electricity. The fan blades 136 radially extend outward from the geometric center of the rotor assembly 130.

The balance weights 202 of FIG. 2 are installed during manufacture of the turbine engine, for example. As explained above, the balance weights can be placed at different locations around the circumference of the rotor in the channel 206. For example, during installation, the weights 202 are in place so that when the drive shaft 200 is attached to the rotor assembly 130 using a tie bolt, the channel 206 is created (e.g., based on the structure of the locknut 201 or other engageable receptacle and the rotor assembly 130 when installed) and the balance weights 202 are fixed into the channel 206 (e.g., sandwiched between (a) a wall of the lock nut 201 and (b) a wall of the rotor assembly 130). Alternatively, the channel 206 may be created when a rotor assembly 130 is attached to an engageable receptacle different than the lock nut 201, such as a second rotor assembly (e.g., using a bolt, a tie bolt, and/or any other device to attach a first rotor to a second rotor) or other rotating component. In such an example, the alternative engageable receptacle includes a section that has a similar shape to the locknut 201 to create the structure of the channel 206. The balance weights 202 have one end that is wider than the other end. The lock nut 201 and the rotor assembly 130 have a similar corresponding structure defining the channel 206 (e.g., with an edge at the upper portion of the respective lock nut 201 and the rotor assembly 130 so that the channel 206 has a bottom portion that is wider than the upper portion where a user can access the balance weight 202 to lock or move the balance weight 202). Such a structure defines the channel 206 so the balance weight 202 cannot be removed and/or fall out when the drive shaft 200 is connected to the rotor assembly 130 via a tie-bolt, as further illustrated below in conjunction with FIG. 3. The balanced weights 202 can be initially set to particular (e.g., equidistant) and/or random positions and adjusted based on the results of a balance test. After being set/secured in the channel 206, the balance weight 202 can be rotated about the circumference of the channel 206 to allows a user to adjust the balance of the rotor assembly 130 while the rotor is in the balance machine and/or at any other point of manufacturer (e.g., including after the rotor assembly 130 is installed), without removing or disassembling a tie bolt and/or the locknut 201 by adjusting the position of the fixed balance weights 202. The rotor assembly 130 can have any number of balance weights 202 positioned in the channel 206 based on user and/or manufacturer preferences.

The dimples 204 of FIG. 2 are included in the rotor assembly 130 (e.g., at the base of the channel 206) to provide areas around the circumference of the channel 206 where the balance weights 202 can be secured (e.g., by guiding a setscrew of the balanced weight into a preset position, as further described below in conjunction with FIG. 3). The dimples 204 can be spaced (e.g., equidistance, no equidistance, randomly, and/or a combination) around the circumference of the channel 206. If a balance test identifies that the balance of the rotor is unbalanced (e.g., based on a threshold), a user and/or machine can rotate one or more of the balance weights 202 to different positions based on the location of the dimples 204 and re-secure the balance weights 202 into place for subsequent balance testing. The dimples 204 can alternatively and/or additionally be and/or include tabs, slots, etc., to facilitate clocking (e.g., securing into position) of the balance weights 202. Although illustrated with a set number of dimples 204 at a set size and shape (e.g., circular), the example rotor assembly 130 can have any number of dimples 204 of any shape and/or size. In some examples, the dimples 204 can be removed and/or not included. The dimples 204 are further described below in conjunction with FIG. 3.

The channel 206 of FIG. 2 allows the balance weights 202 to move (e.g., slide) circumferentially around the channel 206, but prevents the balance weights from being removed from the channel 206 without detaching the lock nut 201 from the rotor assembly 130 (e.g., by detaching the tie-bolt that attaches the drive shaft 200 and/or lock nut 201 to the rotor assembly 130). The channel 206 is structured to be circumferentially wrapped around the geometric center of the rotor assembly 130 (e.g., corresponding to axis 104). For example, the channel 206 is a cavity whose path is a circle, an oval, a loop, etc. formed around the geometric center of the rotor assembly 130. The walls of (a) the lock nut 201 and (b) the rotor assembly 130 are structured into a similar structure (e.g., defining the channel 206) as the balanced weight 202. By circumferentially wrapping, the balanced weight 202 can rotate circumferentially around the rotor assembly 130 without being able to fall out of the channel 206, as further described below in conjunction with FIG. 3 Thus, the balance weights 202 can be moved to adjust the center of mass for the rotor assembly 130 to more closely align with the geometric center (e.g., the axis 104), without risk of breaking or falling off and causing damage.

Figure 3:
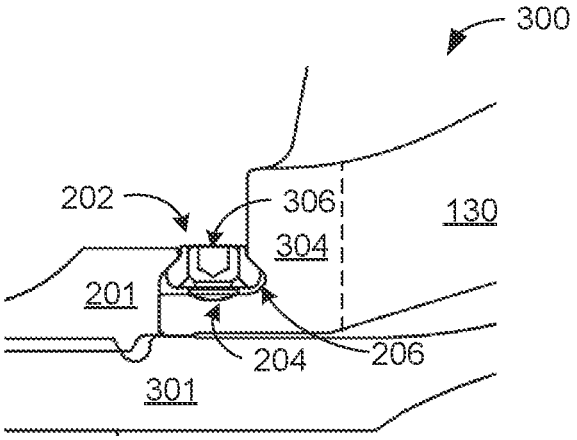
FIG. 3 is cross sectional view of the example implementation of the rotor assembly FIG. 2.

FIG. 3 illustrates an example cross sectional view 300 of a portion of the balance weight 202 secured in the channel 206 between the lock nut 201 and a sidewall 304 of the rotor assembly 130. The cross sectional view 300 includes part of the rotor assembly 130 of FIG. 1, the lock nut 201, the balance weight 202, the dimple 204, and the channel 206 of FIG. 2, a tie rod 301 (as referred to as a tie bolt), a lock nut 201, a sidewall 304, and a set screw 306. Although the example cross section view 300 is described in conjunction with the rotor assembly 130 of FIG. 1, the balance weights 202 can be implemented in conjunction with different drive shafts or other components and/or with different rotor types (e.g., the rotational rotors implemented in the compressor(s) 114, 116 and/or any other type of rotational rotor).

The channel 206 shown in the example of FIG. 3 is defined by the lock nut 201 and the sidewall 304 of the rotor assembly 130. However, as described above, the lock nut 201 may be replaced with a different engageable receptacle, such as a second rotor assembly or other rotating component including a section that has a similar shape to the lock nut 201 to define the channel 206. The alternative engageable receptacle may be attached to the first rotor assembly using a bolt, the tie bolt 301, and/or any other component to attach the second rotor assembly to the first rotor assemble 130. The lock nut 201 is attached to the tie bolt 301 and the tie bolt 301 is attached to the drive shaft 200 and the rotor assembly 130. As described above, the illustrated channel 206 incudes a wider base and a narrower top (e.g., the lock nut 201 and the sidewall 304 are structured to when the drive shaft 200 is coupled to the rotor assembly 130 via the tie bolt 301, the channel 206 has the illustrated shape) corresponding to the structure of the balance weight 202. The wider base and narrower top prevent the example balance weight 202 from being removed or projected out of the channel 206, but the balance weight 202 can be moved circumferentially within the channel 206. To secure the weight to a particular circumferential position around the base (e.g., the geometric center) of the rotor assembly 130, the balance weight 202 includes the set screw 306. A user and/or machine can rotate the set screw 306 to protrude the set screw toward the dimple 204 in the sidewall 304 of the rotor assembly 130 as part of the base of the channel 206. After rotating the set screw 306 by more than a threshold amount, the set screw 306 comes into contact with the dimple 204 to secure the balance weight 202 to a circumferential position within the channel 206 corresponding to the position of the dimple 204. The dimple 204 can guide the balance weight 202 into the preset position. Additionally, the dimple 204 of the sidewall 304 may be shaped to provide additional surface area for the set screw 306 to come in contact with (e.g., then would be available if the base of the channel was flat or did not have a dimple). The additional surface area provides additional static force that keeps the balance weight 202 into the set position while the rotor assembly 130 rotates. To move and/or change the balance weight 202 (e.g., to adjust the balance of the rotor assembly 130), the user and/or machine can rotate the set screw 306 in an opposite direction to move the set screw 306 away from the dimple 204 (e.g., loosen the set screw) to remove the contact with the dimple 204. After the set screw 306 is loosened, the balance weight 202 can be moved and/or slid around the circumference of the channel 206 to another position. Because the balance weight 202 is installed when the drive shaft 200 is coupled to the rotor assembly 130 using the tie bolt 301, balance adjustments can be made by circumferentially moving the balance weights 202 to different positions around the geometric center of the rotor via the channel 206 without removing the tie bolt 301, the lock nut 201, and/or the rotor assembly 130. Although the balance weight 202 includes the set screw 306 to clock the balance weight 202 to a position corresponding to the dimple 204, the balance weight 202 may include any mechanism to clock the weight balance to the position (e.g., a screw, a bolt, a wire, a spring, a device including a screw, a bolt, a wire, a spring, etc.). Although the example view 300 of FIG. 3 includes the rotor assembly 130, the lock nut 201, the channel 206, and the balance weight 202 structured to a particular size/shape, alternative sizes and/or shapes can be used so long as the balanced weight cannot be removed (e.g., but can be moved circumferentially around the geometric center of the rotor assembly 130) from the channel 206 after the lock nut 201 is set in place without removing or disassembling the lock nut 201 and/or a tie bolt 301.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

Further aspects of the invention are provided by the subject matter of the following clauses:

Example 1 includes an apparatus comprising an engageable receptacle, a rotor assembly, a channel defined by the engageable receptacle and the rotor assembly, the channel wrapped circumferentially around a geometric center of the rotor assembly, and a weight trapped within the channel.

Example 2 includes the apparatus of example 1, wherein the weight moves circumferentially within the channel around the geometric center of the rotor assembly.

Example 3 includes the apparatus of example 1, wherein the weight is not removable from the channel without disassembling the engageable receptacle.

Example 4 includes the apparatus of example 1, wherein the weight includes a set screw to lock the weight to a position within the channel.

Example 5 includes the apparatus of example 4, wherein the rotor assembly includes at least one of a dimple, a tab, or a slot at the position of the channel.

Example 6 includes the apparatus of example 1, wherein a position of the weight within the channel affects balance of the rotor assembly.

Example 7 includes the apparatus of example 1, wherein the weight can be moved within the channel after the engageable receptacle and the rotor assembly are connected via a tie bolt.

Example 8 includes the apparatus of example 1, wherein the weight has first end and a second end narrower than the first end.

Example 9 includes the apparatus of example 8, wherein the engageable receptacle and the rotor assembly are structured so that the channel has a third and a fourth end narrower than the third end.

Example 10 includes the apparatus of example 9, wherein the third end of the channel corresponds to the first end of the weight and the fourth end of the channel corresponds to the second end of the weight so that the weight cannot be removed from the channel.

Example 11 includes the apparatus of example 1, wherein the rotor assembly is a first rotor assembly, the engageable receptacle is at least one of a lock nut or a second rotor assembly.

Example 12 includes a turbine engine comprising a shaft, and a rotor coupled to the shaft, the rotor including a section defining a channel around a geometric center of the rotor, the channel including a weight trapped within the channel and movable within the channel.

Example 13 includes the turbine engine of example 12, wherein the rotor and the shaft are to rotate.

Example 14 includes the turbine engine of example 12, wherein the rotor is coupled to the shaft via at least one of a lock nut or a tie bolt.

Example 15 includes the turbine engine of example 14, wherein the lock nut further defines the channel.

Example 16 includes the turbine engine of example 14, wherein the weight is removable from the channel by disassembling the lock nut.

Example 17 includes the turbine engine of example 12, wherein the weight is circumferentially movable within the channel around the geometric center of the rotor.

Example 18 includes the turbine engine of example 12, wherein the weight includes a set screw to lock the weight to a position within the channel.

Example 19 includes the turbine engine of example 18, wherein the rotor includes at least one of a dimple, a tab, or a slot at the position of the channel.

Example 20 includes the turbine engine of example 12, wherein a position of the weight within the channel affects balance of the rotor.

Example 21 includes the turbine engine of example 12, wherein the weight is movable within the channel after the rotor and the shaft are connected.

Example 22 includes the turbine engine of example 12, wherein the rotor is a first rotor, further including a second rotor attached to the first rotor, the second rotor further defining the channel.

From the foregoing, it will be appreciated that example methods and apparatus have been disclosed that correspond to trapped rotatable weights to improve rotor balance. The disclosed trapped rotatable weights allow for the position of preinstalled weights to be adjusted (e.g., moved) circumferentially around the geometric center of a rotor to adjust the balance of the rotor to meet a balance threshold without disassembly of the rotor, a tie bolt, and/or a locknut during balance testing and/or after installation. Additionally, because the rotatable balance weights are trapped (e.g., fixed, secured, etc.) in a channel, even if a screw nut that secures the balance weight into place fails/breaks, there is no risk of the balance weight being projected out of the channel and causing damage to other components of the engine.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The following claims are hereby incorporated into this Detailed Description by this reference, with each claim standing on its own as a separate embodiment of the present disclosure.

What is claimed is:

1. An apparatus comprising:

a lock nut having a first sidewall;

a rotor assembly having a bottom surface and a second sidewall integral with the bottom surface;

a channel defined by the first sidewall of the lock nut and the bottom surface and the second sidewall of the rotor assembly when the lock nut and the rotor assembly are attached together, the channel having an open top side opposite the bottom surface and being wrapped circumferentially around a geometric center of the rotor assembly; and a weight trapped within the channel, wherein the first sidewall and the second sidewall retain the weight within the channel and inhibit the weight from exiting the channel through the open top side when the lock nut and the rotor assembly are attached together.

2. The apparatus of claim 1, wherein the weight is movable circumferentially within the channel around the geometric center of the rotor assembly.

3. The apparatus of claim 1, wherein the weight is not removable from the channel without disassembling the lock nut.

4. The apparatus of claim 1, wherein the weight includes a set screw to lock the weight to a position within the channel.

5. The apparatus of claim 4, wherein the rotor assembly includes at least one of a dimple, a tab, or a slot at the position of the channel.

6. The apparatus of claim 1, wherein the weight can be moved within the channel after the lock nut and the rotor assembly are connected via a tie bolt.

7. The apparatus of claim 1, wherein the weight has first end and a second end narrower than the first end.

8. The apparatus of claim 7, wherein the lock nut and the rotor assembly are structured so that the channel has a third and a fourth end narrower than the third end.

9. The apparatus of claim 8, wherein the third end of the channel corresponds to the first end of the weight and the fourth end of the channel corresponds to the second end of the weight so that the weight cannot be removed from the channel.

10. A turbine engine comprising:

a lock nut having a first sidewall;

a shaft;

a rotor coupled to the shaft, the rotor including a section defining a channel around a geometric center of the rotor, the channel including a weight trapped within the channel and movable within the channel, the rotor assembly having a bottom surface and a second sidewall integral with the bottom surface, wherein the channel is defined by the first sidewall of the lock nut and the bottom surface and the second sidewall of the rotor assembly when the lock nut and the rotor assembly are attached together, wherein the channel comprises an open top side opposite the bottom surface, wherein the first sidewall and the second sidewall retain the weight within the channel and inhibit the weight from exiting the channel through the open top side when the lock nut and the rotor assembly are attached together; and a tie bolt coupling the lock nut to the rotor and the shaft.

11. The turbine engine of claim 10, wherein the weight is removable from the channel by disassembling the tie bolt and the lock nut.

12. The turbine engine of claim 10, wherein the weight includes a set screw to lock the weight to a position within the channel.

13. The turbine engine of claim 12, wherein the rotor includes at least one of a dimple, a tab, or a slot at the position of the channel.

14. The turbine engine of claim 10, wherein the weight is movable within the channel after the rotor, the lock nut, and the shaft are connected.

* * * * *